US005711598A

United States Patent [19]

Tseng

[11] Patent Number: 5,711,598

[45] Date of Patent: Jan. 27, 1998

[54] LAMP DEVICE FOR PRODUCING A KALEIDOSCOPIC LIGHT OUTPUT

[75] Inventor: I-Fu Tseng, Hsien, Taiwan

[73] Assignee: George Weng, Taiwan

[21] Appl. No.: 596,054

[22] Filed: Feb. 6, 1996

[51] Int. Cl.[6] ..... F21V 9/00

[52] U.S. Cl. ..... 362/284; 362/293; 362/302; 362/318; 362/324; 362/811

[58] Field of Search ..... 362/32, 18, 101, 362/268, 277, 282, 284, 299, 300, 301, 302, 304, 318, 319, 322, 324, 293, 806, 311

[56] References Cited

U.S. PATENT DOCUMENTS

| | | | |
|---|---|---|---|
| 3,600,568 | 8/1971 | Belliveau et al. | 362/318 |
| 4,742,439 | 5/1988 | Choate | 362/318 |
| 5,188,452 | 2/1993 | Ryan | 362/319 |
| 5,506,762 | 4/1996 | Ziegler et al. | 362/318 |
| 5,513,083 | 4/1996 | Chang | 362/324 |
| 5,552,975 | 9/1996 | Ho | 362/324 |

*Primary Examiner*—Thomas M. Sember
*Attorney, Agent, or Firm*—Townsend and Townsend and Crew, LLP

[57] ABSTRACT

A lamp device includes a light emitting unit for emitting a light beam, a light filtering unit, first and second focusing lenses, and a total internal reflection unit. The light filtering unit has a glass-holding frame and a pair of flat glasses which are fixed opposedly to the glass-holding frame. A space is formed between the flat glasses. A damping fluid is received in the space, and a plurality of colored glass fragments are dispersed in the damping fluid. The light filtering unit is positioned adjacent the light emitting unit so that the light beam from the light emitting unit can pass through the flat glasses and the colored glass fragments. The first and second focusing lenses are spaced opposedly from one another. The first focusing lens is positioned adjacent the light filtering unit. The total internal reflection unit is mounted between the first and second focusing lenses so that the light beam from the light filtering unit can be emitted through the first focusing lens, reflected by the total internal reflection unit, and emitted from the second focusing lens, thereby producing a kaleidoscopic light output.

3 Claims, 5 Drawing Sheets

LAMP DEVICE FOR PRODUCING A KALEIDOSCOPIC LIGHT OUTPUT

BACKGROUND OF THE INVENTION

1. Field of the Invention

This invention relates to a lamp device, more particularly to a lamp device for producing a kaleidoscopic light output.

2. Description of the Related Art

It is well known that lamp devices are used to provide entertaining effects in addition to illumination. A conventional lamp device may include a light emitting unit for emitting a light beam, and a transparent colored plate which is mounted in front of the light emitting unit so that the light beam can pass through the colored plate and be converted into a colored light beam. A rotary disc which has a plurality of transparent colored plates that are arranged spacedly thereon in a circular formation may be mounted in front of the light emitting unit in order to produce light beams of different colors by rotating the rotary disc and allowing the light to pass through the colored plates. Although light beams of different colors can be produced by means of such a conventional lamp device in order to achieve an entertaining or amusing effect, there is still a need to provide a lamp device which can produce an improved entertaining or amusing effect.

SUMMARY OF THE INVENTION

It is therefore a main object to provide a lamp device which can produce an improved entertaining or amusing effect.

According to the present invention, the lamp device comprises a light emitting unit for emitting a light beam, a light filtering unit, first and second focusing lenses, and a total internal reflection unit.

The light filtering unit has a glass-holding frame, a pair of flat glasses which are fixed opposedly to the glass-holding frame in order to define a space therebetween, a damping fluid received in the space, and a plurality of colored glass fragments dispersed in the damping fluid. The light filtering unit is positioned adjacent the light emitting unit so that the light beam from the light emitting unit can pass through the flat glasses and the colored glass fragments of the light filtering unit.

The first and second focusing lenses are spaced opposedly from one another. The first focusing lens is positioned adjacent the light filtering unit.

The total internal reflection unit is mounted between the first and second focusing lenses so that the light beam from the light filtering unit can be emitted through the first focusing lens, reflected by the total internal reflection unit, and emitted from the second focusing lens, thereby producing a kaleidoscopic light output.

In the preferred embodiment, the lamp device further comprises means for rotating the light filtering unit in order to enable the kaleidoscopic light to rotate, thereby producing an additional amusing effect.

BRIEF DESCRIPTION OF THE DRAWINGS

Other features and advantages of this invention will become apparent in the following detailed description of the preferred embodiments of this invention with reference to the accompanying drawings, in which.

DETAILED DESCRIPTION OF THE PREFERRED EMBODIMENTS

Figure 1:
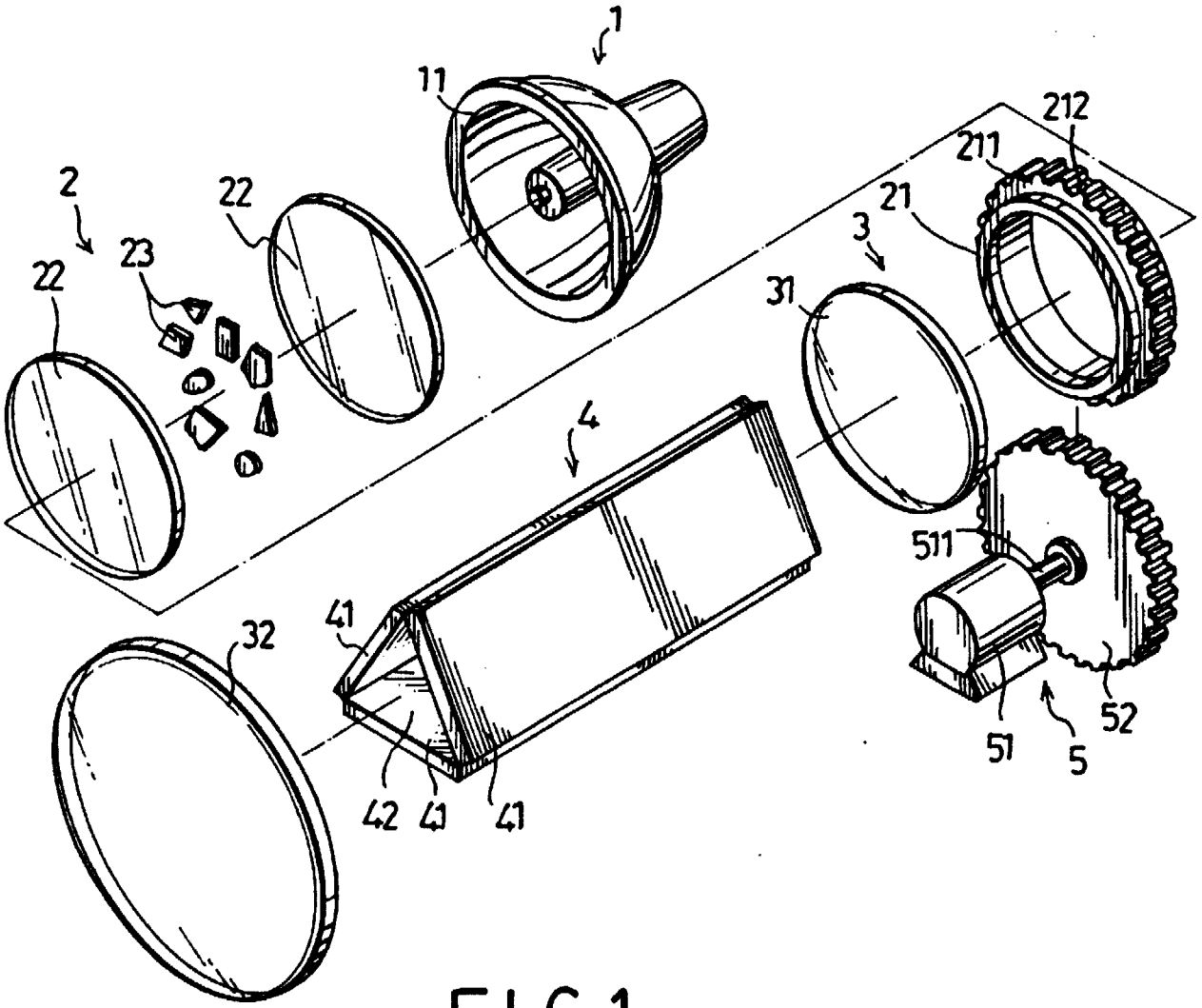
FIG. 1 is an exploded view of a preferred embodiment of a lamp device for producing a kaleidoscopic light output according to the present invention.

Before the present invention is disclosed in greater detail, it should be noted that like elements are denoted by the same reference numerals throughout the disclosure.

Figure 2:
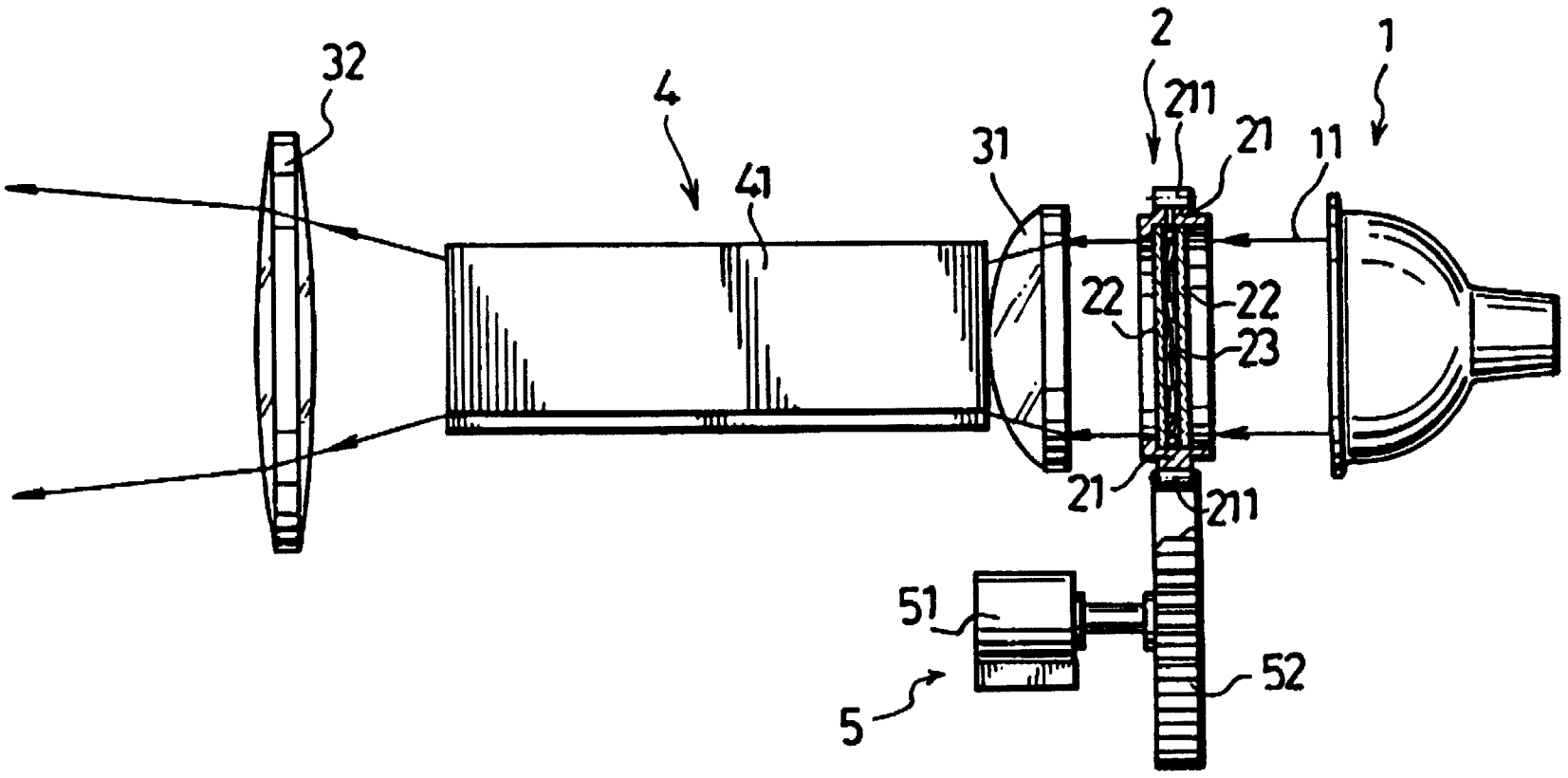
FIG. 2 is a partly sectional top view of the preferred embodiment of the lamp device according to the present invention.

Referring to FIGS. 1 and 2, a preferred embodiment of a lamp device according to the present invention is shown to comprise a light emitting unit 1, a light filtering unit 2, a set of focusing lenses 3, a total internal reflection unit 4, and a rotating means 5.

In this embodiment, the light emitting unit 1 is a filament lamp which can emit a white light beam 11. However, other similar light emitting means capable of emitting a light beam may be used.

The light filtering unit 2 has a glass-holding frame 21, a pair of flat glasses 22, a plurality of colored glass fragments 23 of different shapes and colors. The glass-holding frame 21 is in the form of a ring and has a plurality of teeth 211 which are formed on the outer periphery of the glass-holding frame 21. The flat glasses 22 are fixed opposedly to the glass-holding frame 21 in order to define a space therebetween. A damping fluid 24 is injected into the space through a threaded hole 212 which is formed in the glass-holding frame 21. The threaded hole 212 is closed by a screw (not shown) after the space has been filled with the damping fluid 24. The colored glass fragments 23 are dispersed in the damping fluid 24 and are movable slowly with respect to one another when they are heated by the light emitting units and/or are rotated by the rotating means 5, which will be described in further detail hereinafter.

The light filtering unit 2 is positioned adjacent the light emitting unit 1 so that the light beam 11 from the light emitting unit 1 can pass through the flat glasses 22 and the colored glass fragments 23, as best illustrated in FIG. 2.

The focusing lens set 3 are convex lenses and include first and second focusing lenses 31 and 32 which are spaced opposedly from one another. The first focusing lens 31 is positioned adjacent the light filtering unit 2.

The total internal reflection unit 4 is formed of a plurality of flat mirrors which are connected to one another so as to form a generally tubular member. The total internal reflection unit 4 is mounted between the first and second focusing lenses 31 and 32 so that the colored light beam 11 from the light filtering unit 2 can be emitted through the first focusing lens 31, reflected by the total internal reflection unit 4, and emitted from the second focusing lens 32, thereby producing a kaleidoscopic light output. That is, symmetrical varicolored light beams of different shapes can be emitted by the lamp device of the present invention.

Figure 4:
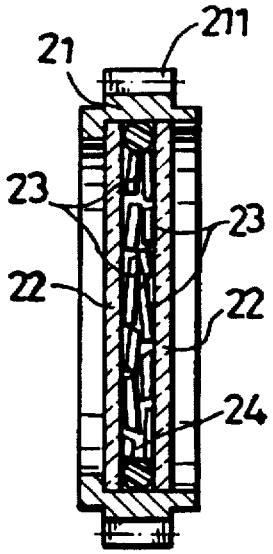
FIG. 4 is an enlarged sectional view of another preferred embodiment of the light filtering unit according to the present invention.
Figure 5:
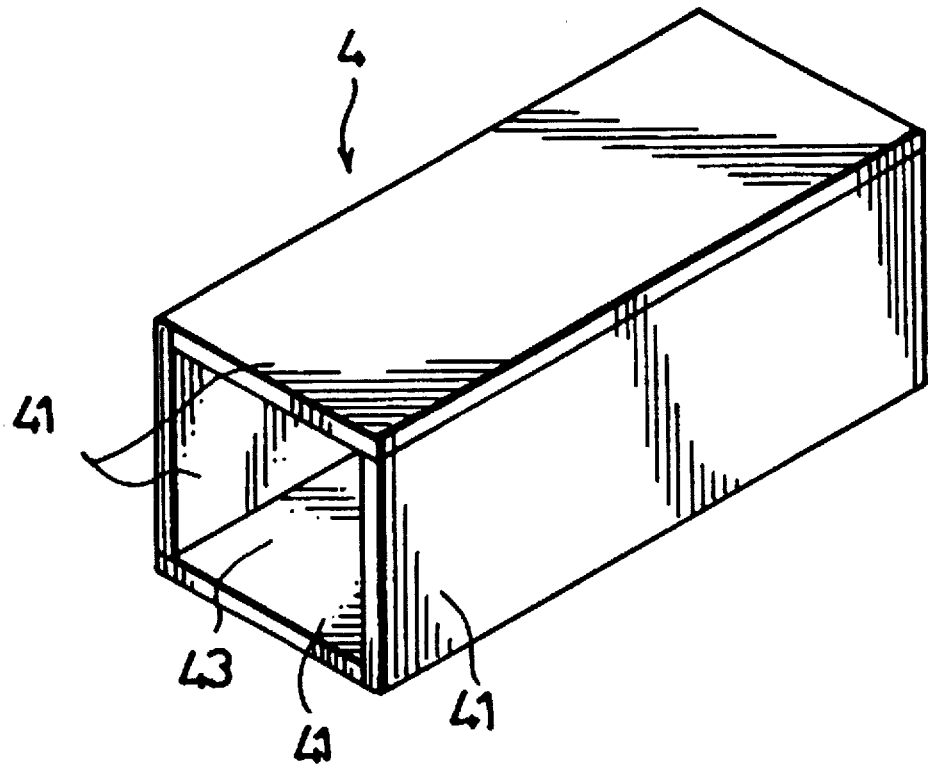
FIG. 5 is a perspective view of another preferred embodiment of the total internal reflection unit of the lamp device according to the present invention.

In the preferred embodiment of FIG. 1, the total internal reflection unit 4 is formed of three flat mirrors 41 which are connected to another at an angle of 60° to define a triangular reflection space 42 therein. The total internal reflection unit 4, however, may also be formed of four flat mirrors 41 which are connected to another at an angle of 90° to form a square reflection space 43 therein, as best illustrated in FIG. 4.

Figure 6:
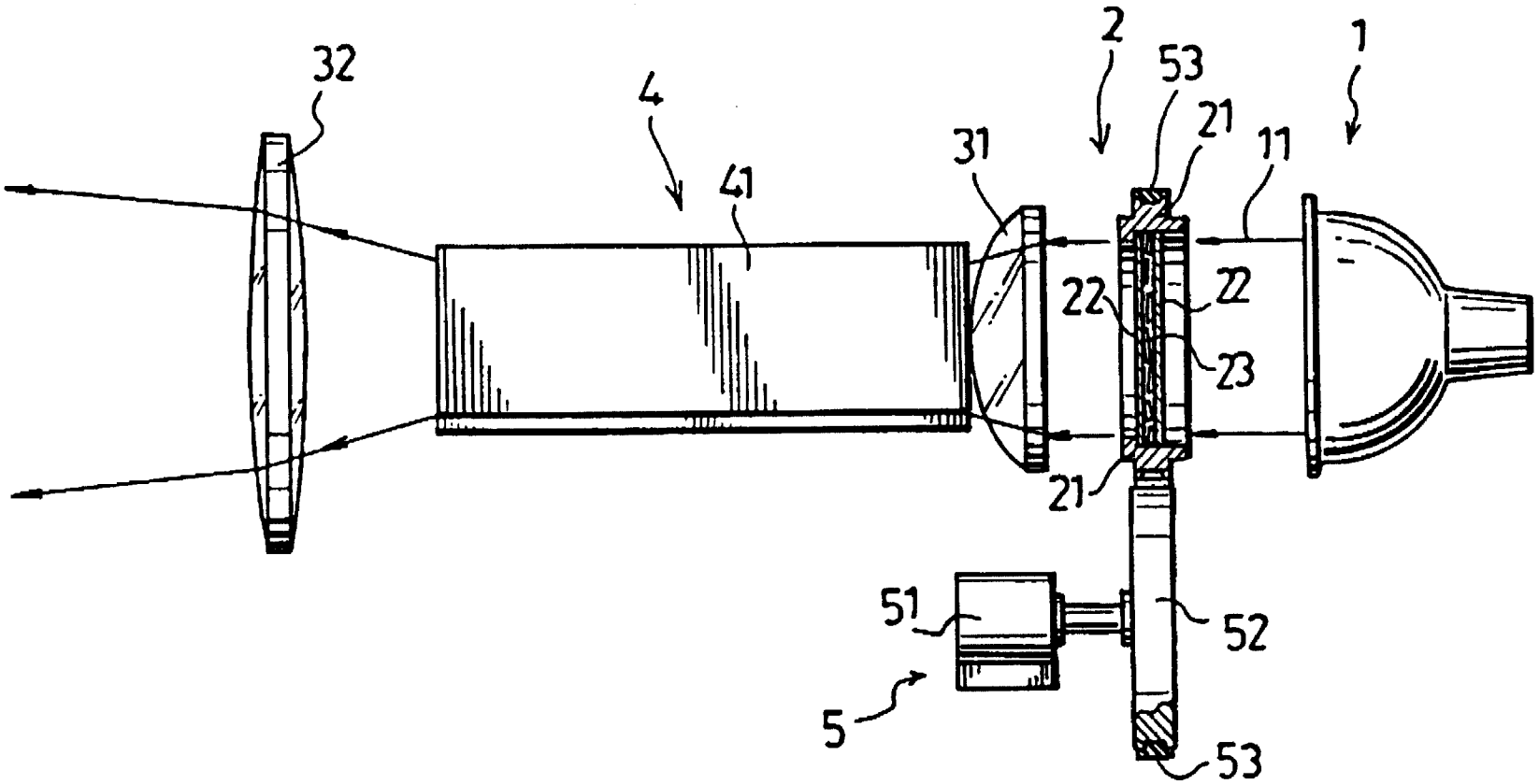
FIG. 6 is a sectional view of another preferred embodiment of the rotating means of the lamp device according to the present invention.

The rotating means 5 includes a driving motor 51 with an output shaft 511, and a gear 52 connected to the output shaft 51. The gear 51 meshes with the teeth 211 of the glass-holding frame 21 in order to drive the glass-holding frame 21 to rotate when the driving motor 51 is actuated. Alternatively, the rotating means 5 may include a driving motor 51 with an output shaft 511, and a transmission belt 53 which is connected to and driven by the output shaft 511, as best illustrated in FIG. 6. The glass-holding frame 21 is formed as a ring connected to the transmission belt 53 so as to be driven rotatably when the driving motor 51 is actuated. When the light filtering unit 2 is rotated by the rotating means 5, an endless variety of rotating, symmetrical, varicolored light beams can be emitted by the lamp device of the present invention in order to produce an additional amusing effect.

Figure 3:
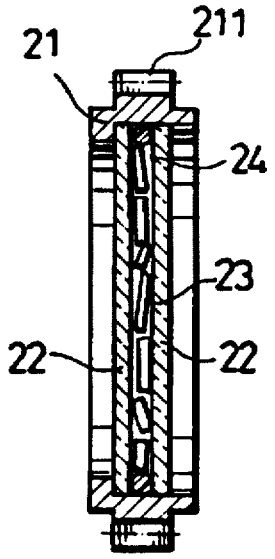
FIG. 3 is an enlarged sectional view of a preferred embodiment of a light filtering unit of the lamp device according to the present invention.

In the aforementioned preferred embodiment, the thickness of each colored glass fragment 22 is slightly smaller than the width of the space between the flat glasses 22 so that the color glass fragments 23 will not overlap one another, as best illustrated in FIG. 3. Therefore, the white light beam 11 can pass through the colored glass fragments 23 individually in order to obtain a varicolored kaleidoscopic light output. However, the width of the space may also be arranged to be larger than twice the thickness of each colored glass fragment 23 so that the color glass fragments 23 can overlap one another, as best illustrated in FIG. 4. Therefore, mixed or compound colors can be produced when the white light beam 11 passes through the overlapping colored glass fragments 23, thereby producing a kaleidoscopic light output which has a greater variety of colors than those of the aforementioned embodiment of FIG. 3.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangement.

I claim:

1. A lamp device comprising:

a light emitting unit for emitting a light beam;

a light filtering unit having a glass-holding frame extending around said light beam, a pair of flat glasses fixed opposedly to said glass-holding frame to define a space between said flat glasses, a damping fluid received in said space, and a plurality of colored glass fragments dispersed in said damping fluid, said light filtering unit being positioned adjacent said light emitting unit so that said light beam from said light emitting unit can pass through said flat glasses and said colored glass fragments of said light filtering unit;

means for rotating said light filtering unit while maintaining said glass holding frame of said light filtering unit in said light beam, said glass-holding frame of said light filtering unit engaging said rotating means;

first and second focusing lenses spaced opposedly from one another, said first focusing lens being positioned adjacent said light filtering unit; and a total internal reflection unit mounted between said first and second focusing lenses so that said light beam from said light filtering unit can be emitted through said first focusing lens, reflected in said total internal reflection unit, and emitted out by said second focusing lens, thereby producing a kaleidoscopic light output.

2. A lamp device as claimed in claim 1, wherein:

said rotating means includes a driving motor with an output shaft, and a gear connected to said output shaft; and said glass-holding frame is formed as a ring and has a plurality of teeth which are formed on an outer periphery of said glass-holding frame and mesh with said gear of said rotating means.

3. A lamp device as claimed in claim 1, wherein:

said rotating means includes a driving motor with an output shaft, and a transmission belt which is connected to and driven by said output shaft; and said glass-holding frame is formed as a ring and is connected to said transmission belt in order to rotate with said transmission belt when said driving motor is actuated.

* * * * *